US006543699B1

(12) United States Patent
Dupre

(10) Patent No.: US 6,543,699 B1
(45) Date of Patent: Apr. 8, 2003

(54) METHOD AND APPARATUS FOR MAKING SNOW

(76) Inventor: Herman K. Dupre, c/o Seven Springs, Champion, PA (US) 15622

( * ) Notice: Subject to any disclaimer, the term of this patent is extended or adjusted under 35 U.S.C. 154(b) by 0 days.

(21) Appl. No.: 09/976,531

(22) Filed: Oct. 15, 2001

(51) Int. Cl.[7] ..... F25C 3/04
(52) U.S. Cl. ..... 239/14.2; 239/2.2; 239/418
(58) Field of Search ..... 239/2.2, 14.2, 239/8, 418, 423, 433, 543

(56) References Cited

U.S. PATENT DOCUMENTS

| | | | | |
|---|---|---|---|---|
| 5,004,151 A | | 4/1991 | Dupre | 239/2.2 |
| 5,810,251 A | | 9/1998 | McKinney | 239/2.2 |
| 5,823,427 A | * | 10/1998 | Dupre et al. | 239/14.2 |
| 5,884,841 A | | 3/1999 | Ratnik et al. | 239/2.2 |
| 5,890,654 A | * | 4/1999 | Dupre | 239/14.2 |
| 6,029,898 A | * | 2/2000 | Dupre | 239/14.2 |
| 6,152,380 A | * | 11/2000 | Dupre | 239/14.2 |
| 6,161,769 A | * | 12/2000 | Kircher et al. | 239/2.2 |

* cited by examiner

*Primary Examiner*—Michael Mar
*Assistant Examiner*—Darren Gorman
(74) *Attorney, Agent, or Firm*—Carothers & Carothers

(57) ABSTRACT

A snow making tower including an elongated tower conduit combination which has an elongated air conduit extending within an elongated water conduit with upper and lower ends and provided with a ground support mount. Air and first water discharge nozzles are respectively provided adjacent the upper ends of the conduits and positioned for producing a plume of atomized water from external interacting air and water discharged under pressure from the air and first water discharge nozzles to produce snow in subfreezing ambient conditions. Couplings are provided for connecting air and water under pressure at the lower end of the tower. Three additional water discharge nozzles are positioned below the first water nozzle and connected to the water conduit for providing additional water sprays which are directed whereby at least portions thereof will intermix with the plume of atomized water as it falls. These additional water nozzles are spaced below the first water nozzle in a vertical sequence and they are dimensioned sequentially for discharging water respectively at a higher rate than each preceding higher nozzle.

11 Claims, 2 Drawing Sheets

METHOD AND APPARATUS FOR MAKING SNOW

BACKGROUND OF THE INVENTION

The present invention relates generally to the art of fluid sprinkling and more particularly to the art of snow making and an improved method and apparatus for artificially making large volumes of high quality snow suitable for skiing.

The present invention pertains to improvements over my invention disclosed in U.S. Pat. No. 5,004,151, issued Apr. 2, 1991. A suitable discussion providing a major portion of the prior art background of the present invention is presented in this patent and also in my U.S. Pat. No. 3,822,825, issued Jul. 9, 1974 and my U.S. Pat. No. 3,952,949, issued Apr. 27, 1976. Accordingly, the background provided in these patents is incorporated herein by reference.

Generally, my former inventions for artificially producing snow consist of a method and apparatus for making snow through the use of snow towers wherein water is supplied under pressure to a point of discharge well above ground level and adjacent the top end of the tower where it is discharged through a nozzle into the ambient freezing atmosphere in the form of a spray. The spray is preferably a high velocity spray of discrete water particles, sometimes referred to as a fine water spray produced by nozzles which are generally referred to as V-jet nozzles.

Air is supplied independently under pressure to a second point of discharge at the top of the snow tower and there discharged through an orifice to form a jet stream which is directed into the aforesaid water spray thereby forming a plume of atomized or nucleated water. This atomized water forms seed crystals in the freezing atmosphere, and through the dwell time of the long fall from the top of tower to the ground, forms snow. My prior methods and apparatus for making snow provide excellent quality snow in reasonable quantities and at a reasonable cost. However, it is my continuing objective and the objective of the industry to provide evermore economic and quality snow making towers which will make excellent quality snow with greater efficiency, at larger quantities and at a lower cost.

My U.S. Pat. No. 5,004,151 discloses the use of multiple water spray nozzles in a vertical array and further discloses that the secondary water spray nozzles may be changed so that some of the nozzles discharge more water than other nozzles and discharge the water at desired nucleated consistencies in order to achieve the most efficient and effective results. However, it is only as a result of this present invention that I have discovered the best and the most unique and efficient arrangement for providing selected different discharge rates for the water spray nozzles in order to achieve the most efficient and affective results. My new invention is thus described hereinafter.

SUMMARY OF THE INVENTION

In the method and apparatus of the present invention, a snow making tower is provided which is comprised of the typical air and water nozzle combination snow tower with the additional teachings of my present invention.

The typical snow tower, as taught by my prior art patents, is comprised of an elongated tower conduit combination, including an elongated air conduit extending within an elongated water conduit and provided with a ground support mount. Air and first water discharge nozzles are respectively provided adjacent the upper ends of these conduits and positioned for producing a plume of atomized water from external interacting air and water discharged under pressure from the air and first water discharge nozzles to produce snow in subfreezing ambient conditions. Couplings are also provided for connecting air and water under pressure respectively to the lower ends of these air and water conduits. At least two and usually three, additional water discharge nozzles are positioned below this first water nozzle and connected to the water conduit for providing additional water sprays and these additional water sprays are directed whereby at least portions thereof will intermix with the plume as it falls towards the ground.

The improvement resides in that these additional water nozzles, which are spaced below the first water nozzle in a vertical sequence, are dimensioned for discharging water respectively at a higher rate than each proceeding higher nozzle.

Also, there will usually be provided at the top of the tower three vertical adjacent sets or banks of these nozzles, each set including an air nozzle and first water discharged nozzle with the two, and preferably three, additional water discharge nozzles positioned respectively therebelow. Each vertical array nozzle set is positioned on opposite sides of the first set at a 60° horizontal spacing whereby three plumes are created and spaced horizontally at 60° from each other.

An example of the nozzle selection for the snow making tower of the present invention is that each of the air discharge nozzles is comprised of a 1/16" diameter discharge hole as opposed to the conventional 1/8" diameter hole and the first water nozzle is selected to have a flow rate of 2 gpm and the additional water nozzles are dimensioned to provide approximate rates of flow which are 2 gpm respectively more than the preceding higher water nozzle. As the ambient temperature increases and the water discharge must be therefore decreased, the additional water nozzles may be closed by selectively plugging these lower water nozzles, typically from the lower most nozzle sequentially to the upper most additional water nozzle, as ambient temperatures increase from below freezing toward the freezing level.

All of the water nozzles are typically angled at approximately 45° relative to vertical or horizontal. The air nozzles are preferably of the venturi type which I have previously disclosed and described in the prior art. These air nozzles provide greater thrust on discharge.

As a result of the nozzle arrangement of the present invention, approximately 1/3 the amount of air is used as compared to my prior art snow making towers. My towers formally required 50 cfm of air and an output of 50 gpm of water at a temperature of 26° F. At the same temperature conditions the tower of my present invention requires only approximately 20 to 22 cfm of air (7 cfm per air nozzle) at 60 gpm of water (total for all water nozzles), and the tower is exceptionally light weight.

Also, the water nozzles of the present invention run at lower rates thereby providing a finer spray and as the subfreezing ambient temperatures increase, more of the lower additional water nozzles may be utilized.

With the snow making tower of the present invention the tower is operating utilizing approximately 1/2 the amount of water previously required and utilizing approximately 1/4 of the air previously required, yet making the same quantities of snow. The snow is much finer and very light due to the use of small nozzles which create a finer spray.

As the nozzle discharge rates increase for the additional water nozzles, the water particles become larger and their throw becomes longer and this assists the additional water sprays to interact better with the falling atomized plume.

BRIEF DESCRIPTION OF THE DRAWINGS

Other objects and advantages appear hereinafter in the following description and claims. The accompanying drawings show, for the purpose of exemplification, without limiting the invention or the claims thereto, certain practical embodiments illustrating the principals of this invention wherein:

DETAILED DESCRIPTION OF A PREFERRED EMBODIMENT

Figure 1:
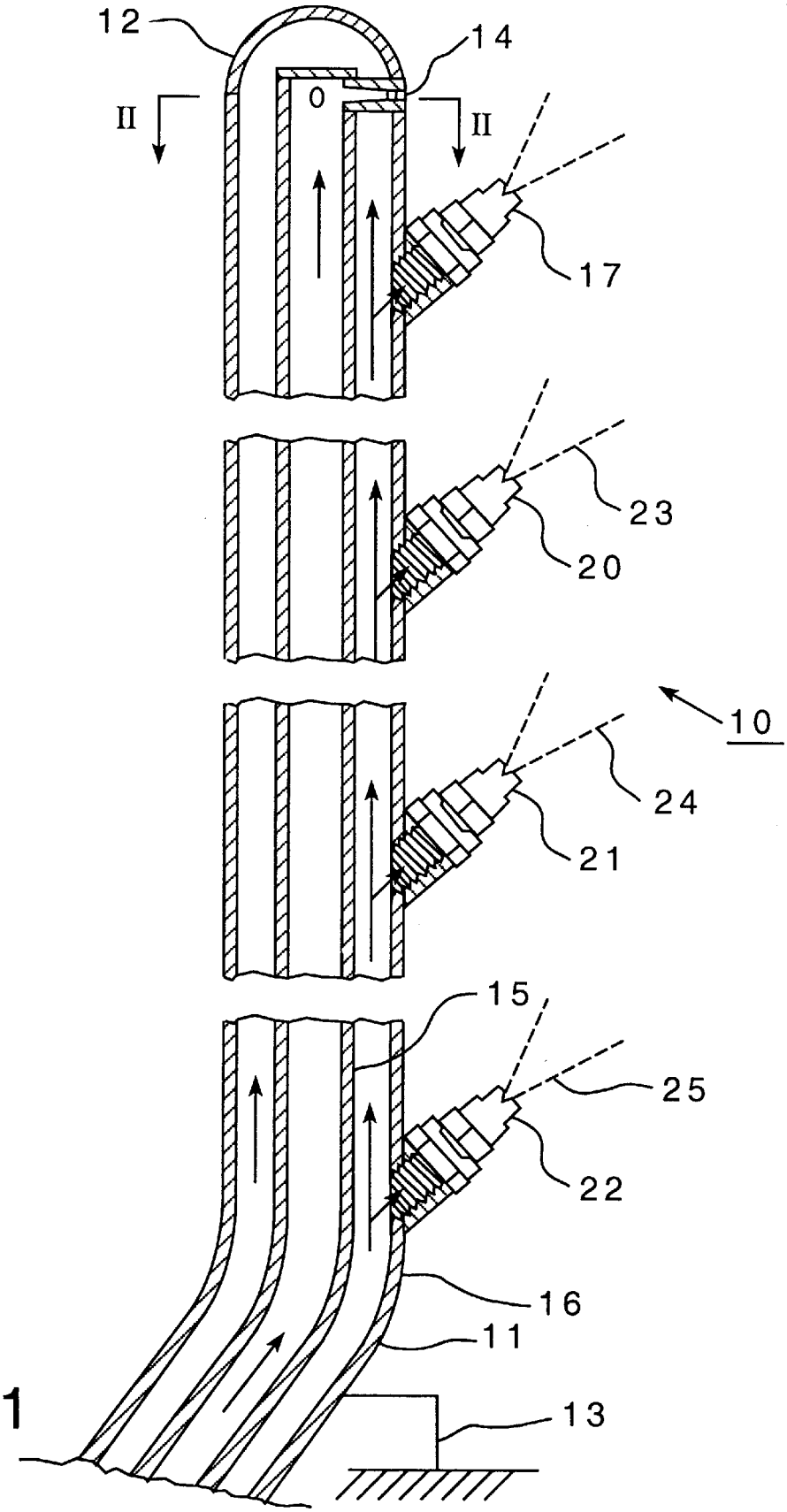
FIG. 1 is a view in side elevation of the upper end of a snow making tower of the present invention shown in vertical mid cross section and with the lower portions of the tower and mounting eliminated.

Referring to the drawings, the snow making tower 10 of the present invention includes an elongated tower conduit combination 11 having upper and lower ends with the upper end 12 being shown. The tower 10 is further provided with a ground support mount herein schematically illustrated at 13. Any one of many ground support mounts may be used for the tower 10 of the present invention as is illustrated in the prior art references previously indicated. The tower is normally at least 10 feet tall.

The elongated tower conduit combination 11 includes an elongated air conduit 15 extending within elongated water conduit 16.

Air discharge nozzle 14 is provided adjacent the upper end of air conduit 15 and first water discharge nozzle 17 is provided adjacent the upper end of water conduit 16 and air nozzle 14 and first water nozzle 17 are positioned for producing a plume of atomized water from external interacting air and water discharged under pressure to produce snow in subfreezing ambient conditions.

Couplings (not shown) are provided for connecting air and water under pressure respectively to the lower ends of air and water conduits 15 and 16 in typical fashion as is done with the aforementioned prior art towers.

At least two, and here three additional water discharge nozzles 20, 21 and 22, are provided and positioned below first water nozzle 17 and connected to the same water conduit 16 for respectively providing additional water sprays 23, 24 and 25, which are directed whereby at least portions thereof will intermix with the plume created by air nozzle 14 and first water nozzle 17 falls toward ground.

Figure 2:
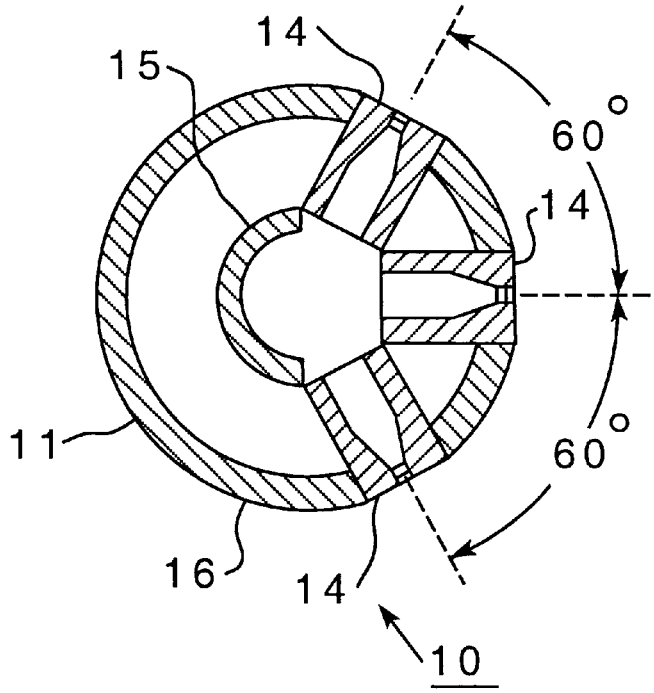
FIG. 2 is an enlarged view in horizontal section of the upper end of the tower shown in FIG. 1 as seen along section line II—II.

Three vertical sets of these nozzle arrangements or arrays are provided, as best indicated in FIG. 2, whereby each vertical set includes at the top an air discharge nozzle 14 and a first water discharge nozzle 17 with three additional water discharge nozzles 20, 21 and 22 positioned respectively therebelow with said nozzle sets being positioned with 60° horizontal spacing as indicated in FIG. 2. This provides three plumes spaced horizontally at 60° from each other to provide a larger area of snow coverage.

The air discharge nozzle 14 is comprised of a 1/16" diameter discharge hole, providing an approximate air discharge of 7 cfm, as compared to the typical 1/8" air hole provided in the towers of the prior art. The air nozzles are of a venturi type whereby they are necked down at the exit to provide more discharge thrust. The first water nozzle 17 and the additional water nozzles 20, 21 and 22 are dimensioned to provide approximate rates of flow of two gallons per minute respectively more than the preceding higher water nozzle. For example, water nozzle 17 would typically be selected to provide a water discharge of 2 gpm and the discharge rate for nozzles 23, 24 and 25 respectively would be 4 gpm, 6 gpm and 8 gpm.

As ambient temperature increases from subfreezing towards the freezing level, the lower additional water nozzles 23, 24 and 25 may be closed off and would typically be closed off starting with the lower most nozzle 25 and then working up as the ambient temperature increases. These nozzles are closed off by lowering the tower and simply removing the nozzles and inserting plugs. As an alternative, independent valving and piping systems may also be used, but they would add additional undesirable weight to the tower.

The first water nozzle and the additional water nozzles 20, 21 and 22 all angled at approximately 45° relative to vertical to provide maximum throw.

I claim:

1. A method of making snow comprising:

supplying water under pressure to a first point of discharge above ground;

discharging the supplied water through a first water nozzle into subfreezing ambient atmosphere in the form of a spray;

independently supplying air under pressure to a second point of discharge above ground;

discharging the supplied air under pressure into said water spray for thereby forming a plume of atomized water to produce snow;

discharging the supplied water through at least two additional water nozzles positioned below said first water nozzle into the ambient atmosphere in the form of additional water sprays directed whereby at least portions thereof will intermix with said plume as it falls, each of said first water nozzle and said additional water nozzles being dimensioned for a different discharge flow rate;

vertically spacing said additional water nozzles below said first water nozzle in a vertical sequence; and discharging water from said additional water nozzles respectively at a higher rate than each preceding higher water nozzle.

2. The method of claim 1, the step of discharging the supplied water, including discharging the supplied water through three of said additional nozzles.

3. The method of claim 2 wherein said air is discharged at the approximate rate of 7 cfm and water is discharged from said first water nozzle at an approximate rate of 2 gpm and water is discharged respectively from said additional water nozzles at approximate successively higher rates of 2 gpm more than the preceding higher water nozzle.

4. The method of claim 3, including successively closing bottom ones of said additional water nozzles, beginning with the lower most water nozzle, when encountering warming ambient temperature conditions.

5. A snow making tower comprising:

an elongated tower conduit combination including an elongated air conduit extending within an elongated water conduit and having upper and lower ends and provided with a ground support mount;

air and first water discharge nozzles respectively provided adjacent the upper ends of said conduits and positioned for producing a plume of atomized water from external interacting air and water discharged under pressure from said air and first water discharge nozzles to produce snow in subfreezing ambient conditions;

couplings for connecting air and water under pressure respectively to the lower ends of said air and water conduits;

at least two additional water discharge nozzles positioned below said first water nozzle and connected to said water conduit for providing additional water sprays and directed whereby at least portions thereof will intermix with said plume as it falls;

said additional water nozzles spaced below said first water nozzle in a vertical sequence and dimensioned for discharging water respectively at a higher rate than each preceding higher nozzle.

6. The snow making tower of claim 5, including three of said additional water discharge nozzles.

7. The snow making tower of claim 6, including at least two additional sets of nozzles, each set of nozzles being formed by an air nozzle, a first water discharge nozzle, and three additional water discharge nozzles positioned respectively therebelow in a vertical sequence, said two additional nozzle sets being positioned on opposite sides of a first nozzle set with their respective nozzles directed at 60° horizontal spacing relative thereto whereby three plumes spaced horizontally at 60° from each other are provided.

8. The snow making tower of claim 7 wherein said air discharge nozzle is comprised of a 1/16 inch diameter discharge hole and said first water nozzle and additional water nozzles are dimensioned to provide approximate rates of flow of 2 gpm respectively more than the preceding higher water nozzle.

9. The snow making tower of claim 8, including means for selectively closing said additional water nozzles depending upon ambient temperature conditions.

10. The snow making tower of claim 9, wherein said first and additional water nozzles are angled at approximately 45° relative to vertical.

11. The snow making tower of claim 5, wherein said air discharge nozzle has a venturi discharge orifice with a tapered neck portion.

* * * * *